US005860223A

United States Patent [19]

Kahl

[11] Patent Number: 5,860,223

[45] Date of Patent: Jan. 19, 1999

[54] DEVICE FOR DRYING A WEB

[75] Inventor: Peter Kahl, Gerstetten, Germany

[73] Assignee: Voith Sulzer Papiermaschinen GmbH, Heidenheim, Germany

[21] Appl. No.: 899,050

[22] Filed: Jul. 23, 1997

[30] Foreign Application Priority Data

Aug. 9, 1996 [DE] Germany ..... 296 13 809 U

[51] Int. Cl.[6] ..... D06F 58/00

[52] U.S. Cl. ..... 34/117; 34/120

[58] Field of Search ..... 34/114, 117, 121, 34/122, 124, 120

[56] References Cited

U.S. PATENT DOCUMENTS

| | | | |
|---|---|---|---|
| 1,595,478 | 8/1926 | Minton | 34/117 |
| 3,504,443 | 4/1970 | Gustafsson | 34/117 |
| 4,539,762 | 9/1985 | Eskelinen et al. | 34/114 |
| 4,893,741 | 1/1990 | Heinzmann | 226/196 |
| 4,996,782 | 3/1991 | Eivola | 34/114 |
| 5,214,861 | 6/1993 | Vuorinen | 34/114 |
| 5,230,168 | 7/1993 | Heinzmann | 34/117 |
| 5,379,526 | 1/1995 | Haverinen | 34/114 |
| 5,477,624 | 12/1995 | Haessner et al. | 34/117 |
| 5,515,619 | 5/1996 | Kahl et al. | 34/114 |
| 5,526,579 | 6/1996 | Kade et al. | 34/117 |

FOREIGN PATENT DOCUMENTS

| | | |
|---|---|---|
| 0394740 | 6/1992 | Austria . |
| 0640716 | 3/1995 | European Pat. Off. . |
| 4404726 | 4/1996 | Germany . |
| 19527289 | 1/1997 | Germany . |
| 2153508 | 8/1985 | United Kingdom . |

*Primary Examiner*—William Doerrler
*Attorney, Agent, or Firm*—Greenblum & Bernstein, P.L.C.

[57] ABSTRACT

Device for drying a web in a two-screen dryer section. The device may include a plurality of heatable dryer cylinders arranged in vertically spaced upper and lower cylinder rows, an upper endless screen associated with the upper cylinder row and a bottom endless screen associated with the bottom cylinder row, and a screen guide roll associated with one of the upper and lower endless screens. A shaft may be formed between adjacent cylinders in a cylinder row and bounded by one of the upper and lower endless screens guided around the adjacent cylinders and the screen guide roll. An air box and a blowing device may be positioned within the shaft, and the blowing device may be arranged in a region of separation between the screen and the screen guide roll to direct an air flow through the screen. The device may also include a longitudinal sealing strip coupled to a surface of the screen guide roll in a vicinity of the region of separation.

18 Claims, 1 Drawing Sheet

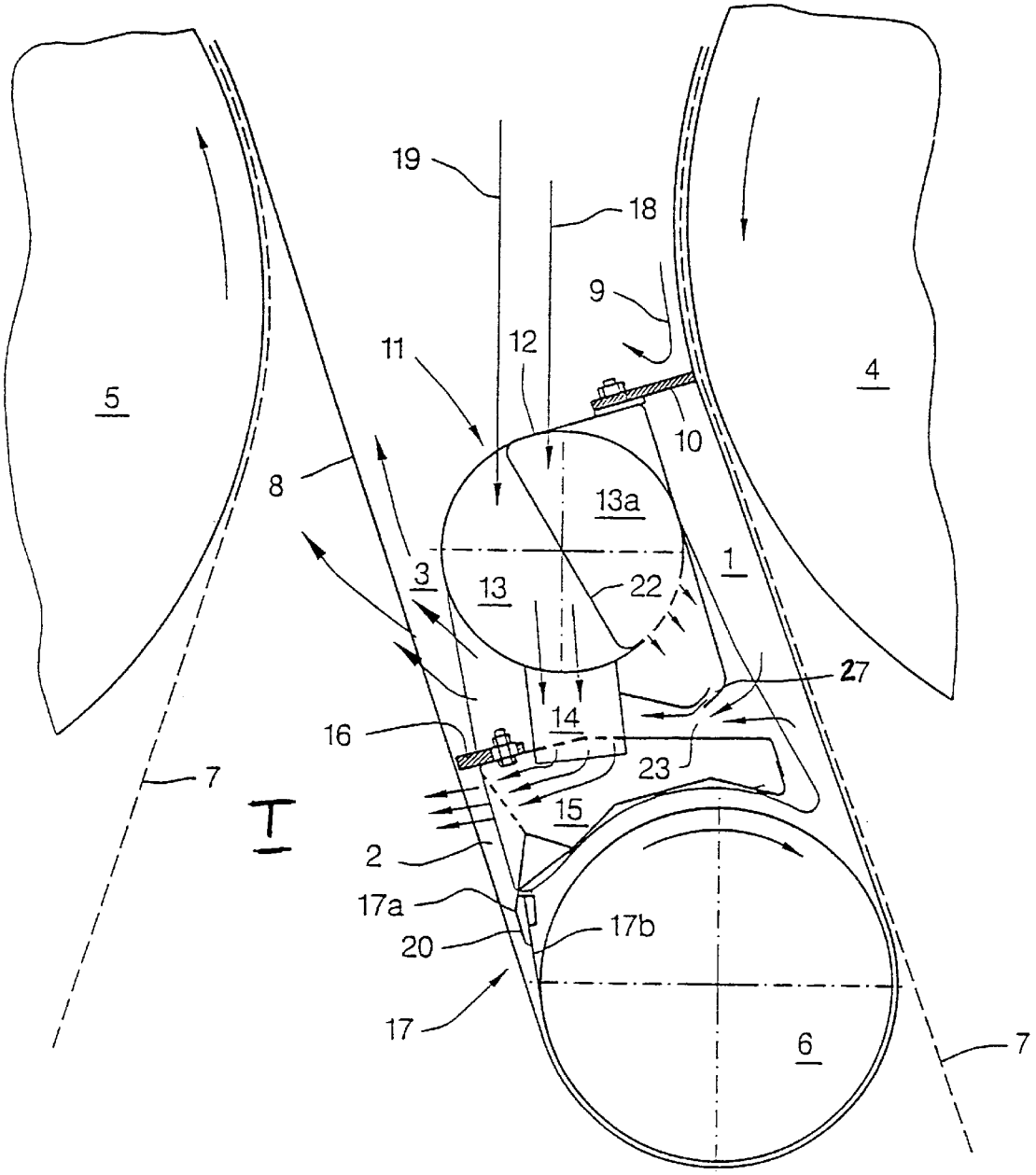
19
18
9
11
12
5
4
10
8
13a
1
3
13
22
27
14
16
23
7
15
2
17a
17b
20
17
6
7

DEVICE FOR DRYING A WEB

CROSS-REFERENCE TO RELATED APPLICATION

The present application claims priority under 35 U.S.C. §119 of German Patent Application No. 296 13 809.6 filed Aug. 9, 1996, the disclosure of which is expressly incorporated by reference herein in its entirety.

BACKGROUND OF THE INVENTION

1. Field of the Invention

The present invention relates to a device for drying a web in a two-screen dryer section, e.g., in a paper manufacturing machine, and for discharging paper shreds and foreign objects entering a loop or shaft formed by the dryer screen.

2. Discussion of Background Information

In the prior art, several devices, e.g., U.S. Pat. No. 5,379,526 and German Patent Application No. DE 44 04 726, have been proposed for removing paper and foreign objects which fall through a dryer screen.

The prior art documents discuss, in general, that upon leaving a dryer cylinder of a first cylinder row, the web to be dried is guided by the dryer screen until the web is lifted off at the screen guide roll. The web then runs, via a free draw in which the web is not supported, to a cylinder of the second cylinder row. This arrangement prevents the risk web flutter and web breaks. Thus, in regions in which the web and/or dryer screens are not running along a defined surface, such as a cylinder surface or guide roll surface, the web and dryer screens are able to steam out without interference.

The dryer screen, after separating from the web, is guided around the screen guide roll to an adjacent dryer cylinder in the cylinder row. The screen forms a loop or shaft and an air box is located within the loop or shaft. A sealing element, supported by the air box, prevents the air boundary layer from being pulled into the shaft and feeds the air boundary layer through the screen running around the first cylinder.

In a region in which the dryer screen loop is not covered with paper, a second air flow exists. The air flow is required to ventilate the "pocket," i.e., the region between the dryer screen and a portion of the web being guided onto the adjacent cylinder in the same row, through the dryer screen. The pocket ventilation is provided in DE '726 via a blowing device positioned in a "discharge wedge" between the screen guide roll and the discharge screen. The blowing device consists of a driving nozzle creating a vacuum to apply suction to the web leaving the first cylinder.

However, the above-discussed methods of vacuum generation, i.e., in a first section of the shaft, and/or pocket ventilation have been shown to be inadequate. In recent years, the operating speed of modern paper manufacturing machines has increased significantly, i.e., in an order of magnitude of 1800 m/min and greater. Thus, an increased drying capacity per dryer cylinder and an increase in the dry air volume is required to remove steam. Therefore, more air must be pushed through the dryer screen into the pocket. Further, in spite of increased speed, the web runs must be maintained as quietly as possible.

For this purpose, German Patent Application No. 195 27 289.7 discloses that, in keeping with the requirements of the system, an air flow at any pressure is fed separately to the blowing device so as to intensify the pocket ventilation, and that an independent second air flow is provided to enable the adjustment of the vacuum present in the shaft via a driving jet. For this purpose an air duct is provided between the air box and the blowing device, which starts out from a first part of the shaft. This advantageously provides a blowing device pressurized with any rate of air flow to randomly intensify the pocket ventilation. By subdividing the air supply system into two subsystems, partial functions can be affected individually.

However, a disadvantage of the systems of DE '726 and DE '289 is that, in the region between the blowing device and the dryer screen discharged by the guide roll, there is a space limited by longitudinal seals in which paper shreds occasionally accumulate which are difficult to remove. Further, in the event of a web break, the paper shreds arrive at a "wrong" side of the dryer screen and are transported by the screen into the shaft and may be caught in the space.

SUMMARY OF THE INVENTION

The present invention overcomes the above-noted defects and drawbacks of the prior art device by automatically removing paper shreds or other foreign objects occasionally dropped into the shaft. The removal may be performed as soon after the paper shred or foreign object enters the shaft to prevent undesired accumulation of the shreds or foreign objects in the space.

The present invention may be directed to a two-screen dryer section that includes a plurality of heatable dryer cylinders arranged in two substantially parallel and vertically displaced cylinder rows, an upper endless screen may be associated with an upper cylinder row and a bottom endless screen may be associated with a bottom cylinder row. Between adjacent cylinders of the cylinder rows, a loop or shaft may be formed by the endless screen as it is guided from one cylinder of a cylinder row to an adjacent cylinder in the cylinder row via a screen guide roll. An air box and a blowing device may be provided in the shaft. The blowing device may be arranged in the shaft to direct an air flow through the screen at a separation region of the screen and the screen guide roll. A longitudinal sealing strip, e.g., a blade, may be attached to a surface of the screen guide roll in a vicinity of the separation region. A blade-shaped longitudinal sealing strip may perform both a sealing function and ensure immediate removal of a foreign object, e.g., transported between the guide roll and the screen, from the shaft. The present invention is equally applicable in the upper row and the lower row of a double row, double screen dryer section.

The present invention may also include an air control system subdivided into two individually controllable sections in a manner substantially similar to DE '289.

Accordingly, the present invention may be directed to a device for drying a web in a two-screen dryer section. The device may include a plurality of heatable dryer cylinders arranged in vertically spaced upper and lower cylinder rows, an upper endless screen associated with the upper cylinder row and a bottom endless screen associated with the bottom cylinder row, and a screen guide roll associated with one of the upper and lower endless screens. A shaft may be formed between adjacent cylinders in a cylinder row and bounded by one of the upper and lower endless screens guided around the adjacent cylinders and the screen guide roll. An air box and a blowing device may be positioned within the shaft, and the blowing device may be arranged in a region of separation between the screen and the screen guide roll to direct an air flow through the screen. The device may also include a longitudinal sealing strip coupled to a surface of the screen guide roll in a vicinity of the region of separation.

In accordance with another feature of the present invention, the longitudinal sealing strip may include a blade holder mounted on the blowing device and a blade. The blade holder may be coupled to the blade.

In accordance with another feature of the present invention, the longitudinal sealing strip may include a side facing the screen having an essentially smooth surface.

In accordance with still another feature of the present invention, the screen guide roll may be located between adjacent first and second cylinders of one of the upper and lower cylinder rows, and the web and the one endless screen may be guided together from the first cylinder to the screen guide roll. The web and the one endless screen may be separated at the screen guide roll and the web may be guided in a free draw to a cylinder of the other of the upper and lower cylinder rows.

In accordance with a further feature of the present invention, the device may also include an air duct located between the air box and the blowing device, and at least one driving jet may be directed into the air duct to evacuate air from a first part of the shaft, thereby drawing the web onto the dryer screen. Further, blast air may interdependently pressurize the driving jet and the blowing device.

The present invention may be directed to a device for guiding a web and for removing paper shreds that enter a shaft in a two-screen double row dryer section. The two-screen double row dryer section may include an upper and lower dryer cylinder row having a dryer screen with a screen guide roll positioned in a gap between adjacent first and second dryer cylinders of a same dryer cylinder row, a shaft formed by a portion of the dryer screen associated with one of the upper and lower dryer cylinder row in a region of separation from the first dryer cylinder, guided around the screen guide roll, and guided onto the second dryer cylinder. The device may include a sealing strip positioned within the shaft and adjacent the screen guide roll to remove paper shreds from the screen guide roll and a blower box positioned within the shaft and adjacent the screen guide roll. The blower box may direct an air flow and the paper shreds through the dryer screen in a direction substantially toward the second dryer cylinder.

In accordance with another feature of the present invention, the device may include an air box having an air jet nozzle substantially directed toward the second dryer cylinder. Further, the air jet nozzle may create a suction to couple the web to a portion of the dryer screen located between the region of separation from the first dryer cylinder and the screen guide roll. Still further, the blower box may be coupled to an output of the air box to receive compressed air.

In accordance with still another feature of the present invention, the device may include a first, second and third part. The first part may include a vacuum section to act on the web, the second part may be associated with the blower box, and the third part may include a blower for removing steam generated in the vacuum section.

In accordance with a further feature of the present invention, the sealing strip may include a scraper having a scraper end coupled to the screen guide roll in a vicinity of a separation of the dryer screen.

In accordance with still another feature of the present invention, the blower box may be coupled to a compressed air source.

In accordance with a still further feature of the present invention, the compressed air source may include an air box. Further, the air box may include a first and second air duct, and the second air duct may be coupled to the blower box. Still further, the air box may include an internal partition separating a first and second air duct. The first air duct may be coupled to the blower box and the second air duct may form a vacuum to couple the web to a portion of the dryer screen.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, in reference to the noted drawing by way of non-limiting example of a preferred embodiment of the present invention, and wherein:

The Figure illustrates a portion of a two-screen dryer cylinder arrangement.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figure making apparent to those skilled in the art how the invention may be embodied in practice.

The Figure may illustrate a portion of a two-screen double row dryer section in which two adjacent dryer cylinders 4 and 5 of an upper row of the dryer section are shown. Further, a web 7 is shown being guided around dryer cylinder 4 by a dryer screen 8 to a screen guide roll 6. At screen guide roll 6, web 7 may be lifted off or separated from dryer screen 8 and guided to a dryer cylinder of the lower cylinder row (not shown). Dryer screen 8 may be guided around screen guide roll 6 and guided toward adjacent dryer cylinder 5 of the upper row to form a loop or shaft. Web 7 is guided around the dryer cylinder of the lower dryer row and guided to dryer cylinder 5 of the upper cylinder row. Web 7 is then guided around dryer cylinder 5 by dryer screen 8. A boundary air layer 9, which may be carried along dryer cylinder 4 by a surface of dryer screen 8 opposite dryer cylinder 4, may be diverted by a seal 10 of an air box 11. The arrangement of the dryer screen and dryer cylinders for the lower cylinder row may be substantially the same, albeit inverted, as the Figure.

An air box 11 may form and expel air as a driving jet 27. Driving jet 27 may be formed by a supply line 18 and an air duct 13*a* of air box 11. Because driving jet 27 is directed into air duct 23, a flow may build up to form a vacuum in a region 1 of the shaft. Thus, in region 1, web 7 may be suctioned onto dryer screen 8 so that steam produced from the drying of the web and escaping from dryer screen 8 may also evacuated. These air flows may reach a region 3 through air duct 23, where they may be expelled without interference. Further, at least a portion of the expelled air may enter into a pocket T formed between dryer screen 8 between screen guide roll 6 and dryer cylinder 5 and web 7 between the lower cylinder row and dryer cylinder 5.

The present invention may also include a blowing device 15, which may be separate from air box 11 with respect to ventilation. That is, blowing device 15 may be located in an immediate vicinity of screen guide roll 6, i.e., in a bottom region 2 of the shaft in the upper cylinder row and in a top region of the shaft in the lower cylinder row. Blowing device 15 may be provided with a plurality of blow openings directed through screen 8 toward pocket T. Blowing device 15 may be supplied with compressed air via a supply line 19 and air ducts 13 and 14 of air box 11. Alternatively, the present invention also contemplates that blowing device 15 may be provided with a dedicated lateral compressed air connection. In the alternative embodiment, no connecting air ducts 14 would be necessary between the air box 11 and blowing device 15.

A wedge-shaped region 2 of the shaft, i.e., formed between blowing device 15, screen guide roll 6 and screen 8, may be further delimited by longitudinal sealing elements 16 and 17 extending substantially perpendicular or transverse to a screen travel direction. Longitudinal sealing strip 16 may extend along screen 8 immediately adjacent and downstream, with respect to the screen travel direction, of the plurality of blower openings of blowing device 15. Longitudinal strip 17 may extend along the outer surface of screen guide roll 6 to form a scraper blade. Longitudinal sealing strip 17 may include a blade holder 17*a* mounted on blowing device 15 and a blade 17*b* supported by blade holder 17*a*. In the view shown in the Figure, a free end of blade 17*b* may be placed on or adjacent the surface of screen guide roll 6 with little force. A side 20 of blade 17*b* and blade holder 17*a,* which faces screen 8, should be as smooth as possible to ensure that any paper shreds or similar foreign objects do not hang on longitudinal seal strip 17. The free end of blade 17*b* may extend as far as possible in a direction of the separation region of screen 8 of screen guide roll 6. In this manner, paper shreds or similar foreign objects may be forced to quickly move in a direction toward cylinder 5 and, thus, toward the outside.

In an alternative to the preferred embodiment depicted in the Figure, air box 11, for example, may be provided with a pipe 12 as a supporting element, and an interior may be subdivided into two halves by an internal partition 22 to form air ducts 13 and 13*a*. Blowing device 15 may be rigidly coupled with pipe 12 via air ducts 14.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A device for drying a web in a two-screen dryer section comprising:

a plurality of heatable dryer cylinders arranged in vertically spaced upper and lower cylinder rows;

an upper endless screen associated with the upper cylinder row and a bottom endless screen associated with the bottom cylinder row;

a screen guide roll associated with one of the upper and lower endless screens;

a shaft formed between adjacent cylinders in a cylinder row and bounded by one of the upper and lower endless screens guided around the adjacent cylinders and the screen guide roll;

an air box and a blowing device positioned within the shaft, the blowing device arranged adjacent to a region of separation between the screen and the screen guide roll to direct an air flow through the screen;

a longitudinal sealing strip coupled to a surface of the screen guide roll in a vicinity of the region of separation; and the longitudinal sealing strip comprising a blade holder mounted on the blowing device, a blade being coupled to the blade holder.

2. The device according to claim 1, the longitudinal sealing strip comprising a side facing the screen having an essentially smooth surface.

3. The device according to claim 1, the screen guide roll being located between adjacent first and second cylinders of one of the upper and lower cylinder rows;

the web and the one endless screen being guided together from the first cylinder to the screen guide roll; and the web and the one endless screen being separating at the screen guide roll and the web being guided in a free draw to a cylinder of the other of the upper and lower cylinder rows.

4. The device according to claim 1, further comprising an air duct located between the air box and the blowing device;

at least one driving jet being directed into the air duct to evacuate air from a first part of the shaft, thereby drawing the web onto the dryer screen.

5. The device according to claim 4, further comprising blast air interdependently pressurizing the driving jet and the blowing device.

6. A device for guiding a web and for removing paper shreds that enter a shaft in a two-screen double row dryer section, each of an upper and lower dryer cylinder row having a dryer screen with a screen guide roll positioned in a gap between adjacent first and second dryer cylinders of a same dryer cylinder row, the shaft being formed by a portion of the dryer screen associated with one of the upper and lower dryer cylinder row in a region of separation from the first dryer cylinder, guided around the screen guide roll, and guided onto the second dryer cylinder, the device comprising:

a sealing strip positioned within the shaft and adjacent the screen guide roll to remove paper shreds from the screen guide roll;

a blower box positioned within the shaft and adjacent the screen guide roll, the blower box directing an air flow and the paper shreds through the dryer screen in a direction substantially toward the second dryer cylinder; and the sealing strip comprising a scraper having a scraper end coupled to the screen guide roll in a vicinity of a separation region in which the dryer screen separates from the screen guide roll.

7. The device according to claim 6, further comprising:

an air box having an air jet nozzle substantially directed toward the second dryer cylinder.

8. The device according to claim 7, the air jet nozzle creating a suction to couple the web to a portion of the dryer screen located between the region of separation from the first dryer cylinder and the screen guide roll.

9. The device according to claim 7, the blower box being coupled to an output of the air box to receive compressed air.

10. The device according to claim 6, further comprising a first, second and third part;

the first part comprising a vacuum section to act on the web;

the second part associated with the blower box; and the third part comprising a blower for removing steam generated in the vacuum section.

11. The device according to claim 6, the blower box coupled to a compressed air source.

12. The device according to claim 6, the compressed air source comprising an air box.

13. The device according to claim 12, the air box comprising a first and second air duct, the second air duct coupled to the blower box.

14. The device according to claim 12, the air box comprising an internal partition separating a first and second air duct;

the first air duct coupled to the blower box; and the second air duct forming a vacuum to couple the web to a portion of the dryer screen.

15. The device in accordance with claim 1, a free end of the blade extending substantially to a point of separation within the separation region.

16. The device in accordance with claim 1, a free end of the blade being positioned to remove at least one of paper shreds and foreign objects from a surface of the screen guide roll substantially immediately after a point of separation within the separation region.

17. The device in accordance with claim 6, the scraper end blade extending substantially to a point of separation within the separation region.

18. The device in accordance with claim 6, scraper end being positioned to remove at least one of paper shreds and foreign objects from a surface of the screen guide roll substantially immediately after a point of separation within the separation region.

* * * * *